US009067123B1

(12) United States Patent
Robbins

(10) Patent No.: US 9,067,123 B1
(45) Date of Patent: Jun. 30, 2015

(54) WORKOUT GLOVE HAVING A WRIST WRAP

(71) Applicant: Jonathan D. Robbins, Bountiful, UT (US)

(72) Inventor: Jonathan D. Robbins, Bountiful, UT (US)

(73) Assignee: Fit Four, LLC, Bountiful, UT (US)

( * ) Notice: Subject to any disclaimer, the term of this patent is extended or adjusted under 35 U.S.C. 154(b) by 0 days.

(21) Appl. No.: 14/612,877

(22) Filed: Feb. 3, 2015

Related U.S. Application Data

(60) Provisional application No. 61/944,641, filed on Feb. 26, 2014.

(51) Int. Cl.
*A41D 19/00* (2006.01)
*A63B 71/14* (2006.01)
*A41D 19/015* (2006.01)

(52) U.S. Cl.
CPC ..... *A63B 71/141* (2013.01); *A41D 19/01547* (2013.01); *A63B 2244/09* (2013.01)

(58) Field of Classification Search
CPC ..... A41D 13/08; A41D 13/082; A41D 19/00; A41D 19/0044; A63B 71/148; A63B 71/146
USPC ..... 2/16, 20, 159, 160, 161.1, 161.2, 161.3, 2/161.6, 162
See application file for complete search history.

(56) References Cited

U.S. PATENT DOCUMENTS

| | | | | |
|---|---|---|---|---|
| 3,928,871 | A * | 12/1975 | Wall | 2/161.8 |
| 4,531,241 | A * | 7/1985 | Berger | 2/161.2 |
| 4,905,321 | A * | 3/1990 | Walunga | 2/161.1 |
| 5,528,772 | A * | 6/1996 | Cheek | 2/161.1 |
| 5,689,828 | A * | 11/1997 | Mah | 2/16 |
| 7,210,172 | B2 * | 5/2007 | Adams, Jr. | 2/163 |
| 8,196,219 | B2 * | 6/2012 | Roeckl | 2/16 |
| 8,245,715 | B1 * | 8/2012 | Davis | 132/213.1 |
| 8,863,312 | B1 * | 10/2014 | Gary | 2/20 |

* cited by examiner

*Primary Examiner* — Tejash Patel
(74) *Attorney, Agent, or Firm* — Brian Tucker; Kirton McConkie

(57) ABSTRACT

A workout glove can include an integrated wrist wrap. The workout glove comprises a hand portion within which a wearer's hand is placed and a wrist wrap attached to a proximal edge of the hand portion and configured to extend around the wearer's wrist when the wearer's hand is placed in the hand portion. The hand portion includes one or more open-ended sheaths through which corresponding one or more of the wearer's fingers extend and a thumb opening through which the wearer's thumb extends and which exposes the wearer's thumb.

20 Claims, 7 Drawing Sheets

WORKOUT GLOVE HAVING A WRIST WRAP

CROSS-REFERENCE TO RELATED APPLICATIONS

This application claims the benefit of U.S. Provisional Patent Application No. 61/944,641 which was filed on Feb. 26, 2014

BRIEF SUMMARY

The present invention is generally directed to a workout glove that includes an integrated wrist wrap. The workout glove comprises a hand portion within which a wearer's hand is placed and a wrist wrap attached to a proximal edge of the hand portion and configured to extend around the wearer's wrist when the wearer's hand is placed in the hand portion. The hand portion includes one or more open-ended sheaths through which corresponding one or more of the wearer's fingers extend and a thumb opening through which the wearer's thumb extends and which exposes the wearer's thumb.

In some embodiments, the thumb opening can be configured to expose a portion of the wearer's palm. Also, in some embodiments, the hand portion can form an opening on the back side of the wearer's hand. Such designs can minimize the amount of the wearer's hand that is covered by the glove while still providing adequate protection against blisters and/or calluses during workout.

This summary is provided to introduce a selection of concepts in a simplified form that are further described below in the Detailed Description. This Summary is not intended to identify key features or essential features of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
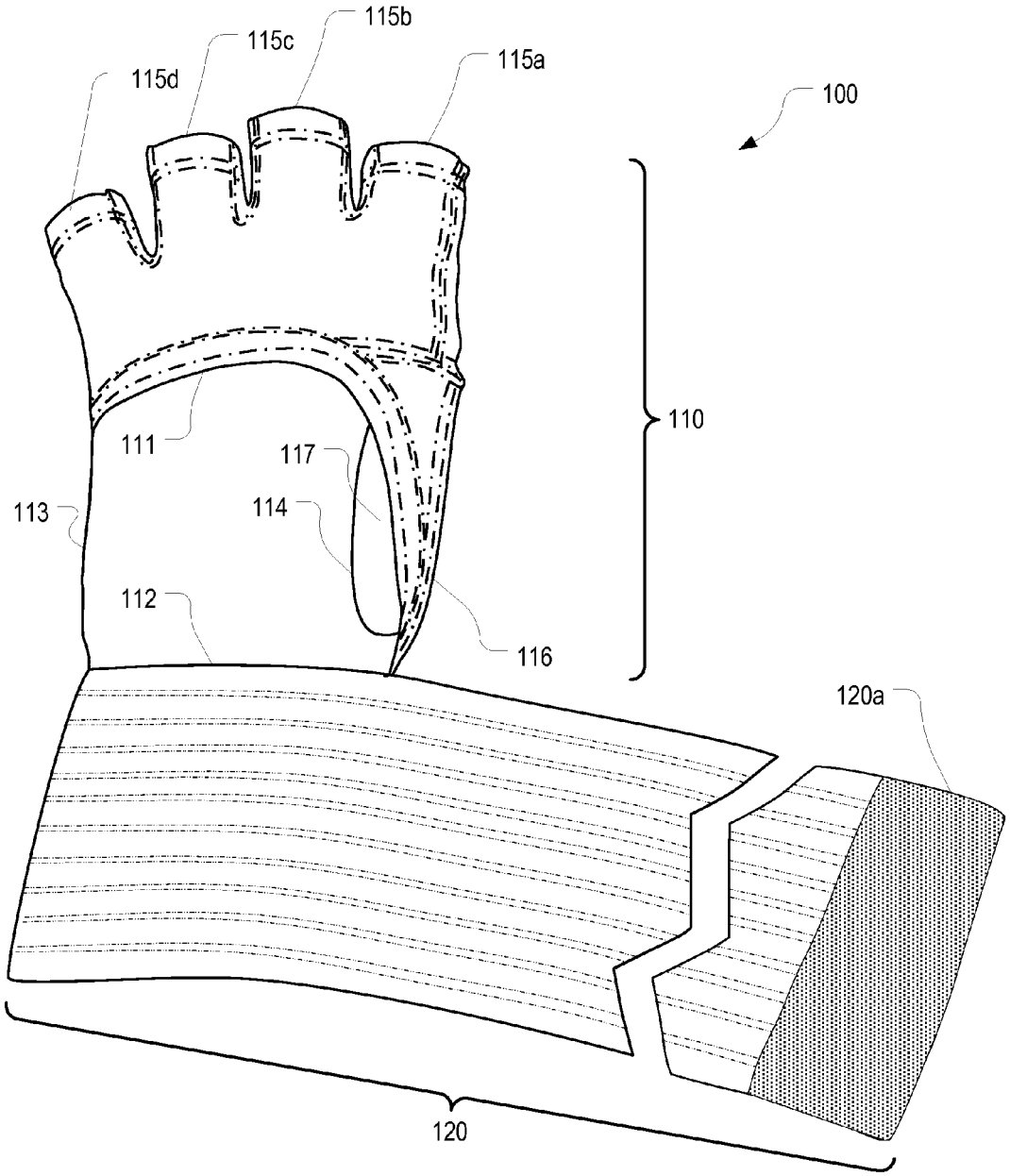
FIG. 1 illustrates an example of a left-handed workout glove configured in accordance with the present invention. The view in FIG. 1 is of the back side of the workout glove with the wrist wrap extended.

The present invention is generally directed to a workout glove that includes an integrated wrist wrap. The workout glove comprises a hand portion within which a wearer's hand is placed and a wrist wrap attached to a proximal edge of the hand portion and configured to extend around the wearer's wrist when the wearer's hand is placed in the hand portion. The hand portion includes one or more open-ended sheaths through which corresponding one or more of the wearer's fingers extend and a thumb opening through which the wearer's thumb extends and which exposes the wearer's thumb.

In some embodiments, the thumb opening can be configured to expose a portion of the wearer's palm. Also, in some embodiments, the hand portion can form an opening on the back side of the wearer's hand. Such designs can minimize the amount of the wearer's hand that is covered by the glove while still providing adequate protection against blisters and/or calluses during workout.

FIGS. 1-7 illustrate various views of an example workout glove 100 configured in accordance with one or more embodiments of the present invention. Glove 100 comprises a hand portion 110 and a wrist wrap 120. A portion of wrist wrap 120 is connected along a front-side (or palm-side) proximal edge 112 of hand portion 110. Front-side proximal edge 112 can be configured so that it extends along the base of the wearer's palm at or near the wrist joint. The portion of wrist wrap 120 that is not connected to hand portion 110 can be wrapped around the wearer's wrist. An end of wrist wrap 120 can include hook and loop or other connecting means 120*a* for securing the end of wrist wrap 120 in place.

Hand portion 110 includes four open-ended sheaths 115*a*-115*d* at a distal end of the glove through which the wearer's fingers extend. The length of open-ended sheaths 115*a*-115*d* can be configured so that the open-ended sheaths do not cover the intermediate phalanges (e.g. so that they extend up to the second knuckle). However, in some embodiments, open-ended sheaths 115*a*-115*d* can extend at least partially over the intermediate phalanges.

Although glove 100 includes four open-ended sheaths, in some embodiments, a workout glove can contain less than four open-ended sheaths. For example, a glove can be configured with only open-ended sheaths 115*a*, 115*b* (i.e., one for the index finger and one for the middle finger). Other arrangements of fewer than four open-ended sheaths can also be used. In embodiments where fewer than four open-ended sheaths are employed, hand portion 110 can include an opening for one or more of the fingers for which no open-ended sheath is provided. For example, if open-ended sheaths are provided for the index and middle fingers only, the ring and pinky fingers may extend out through a single opening.

Also, in some embodiments, the length of one open-ended sheath may be different than the length of another open-ended sheath. For example, an open-ended sheath for the middle finger may extend up to the second knuckle while an open-ended sheath for the ring finger may extend only half way over the proximal phalange.

Figure 3:
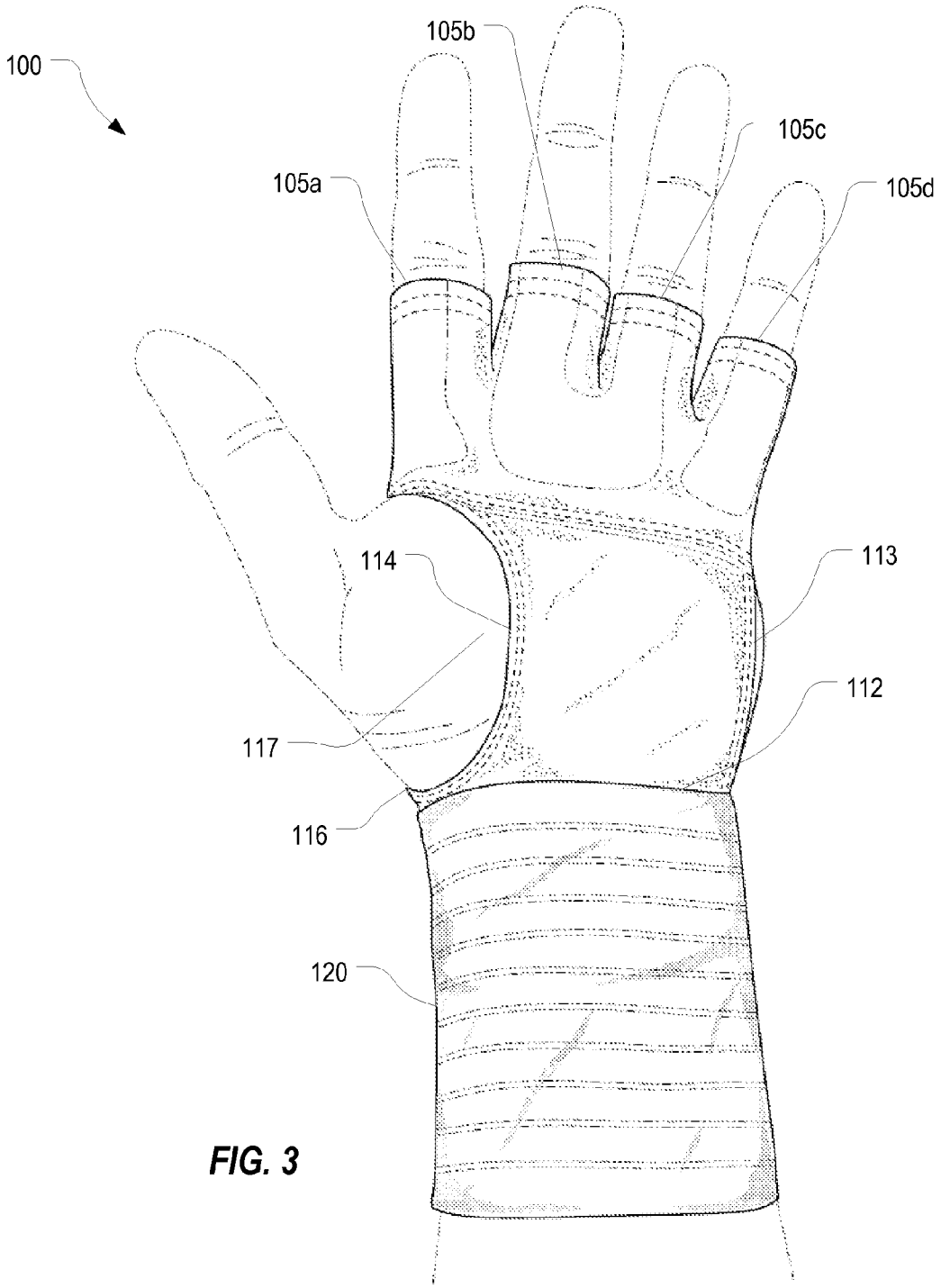
FIG. 3 illustrates a front side view of a left-handed workout glove in accordance with one or more embodiments of the present invention when worn on the left hand.
Figure 5:
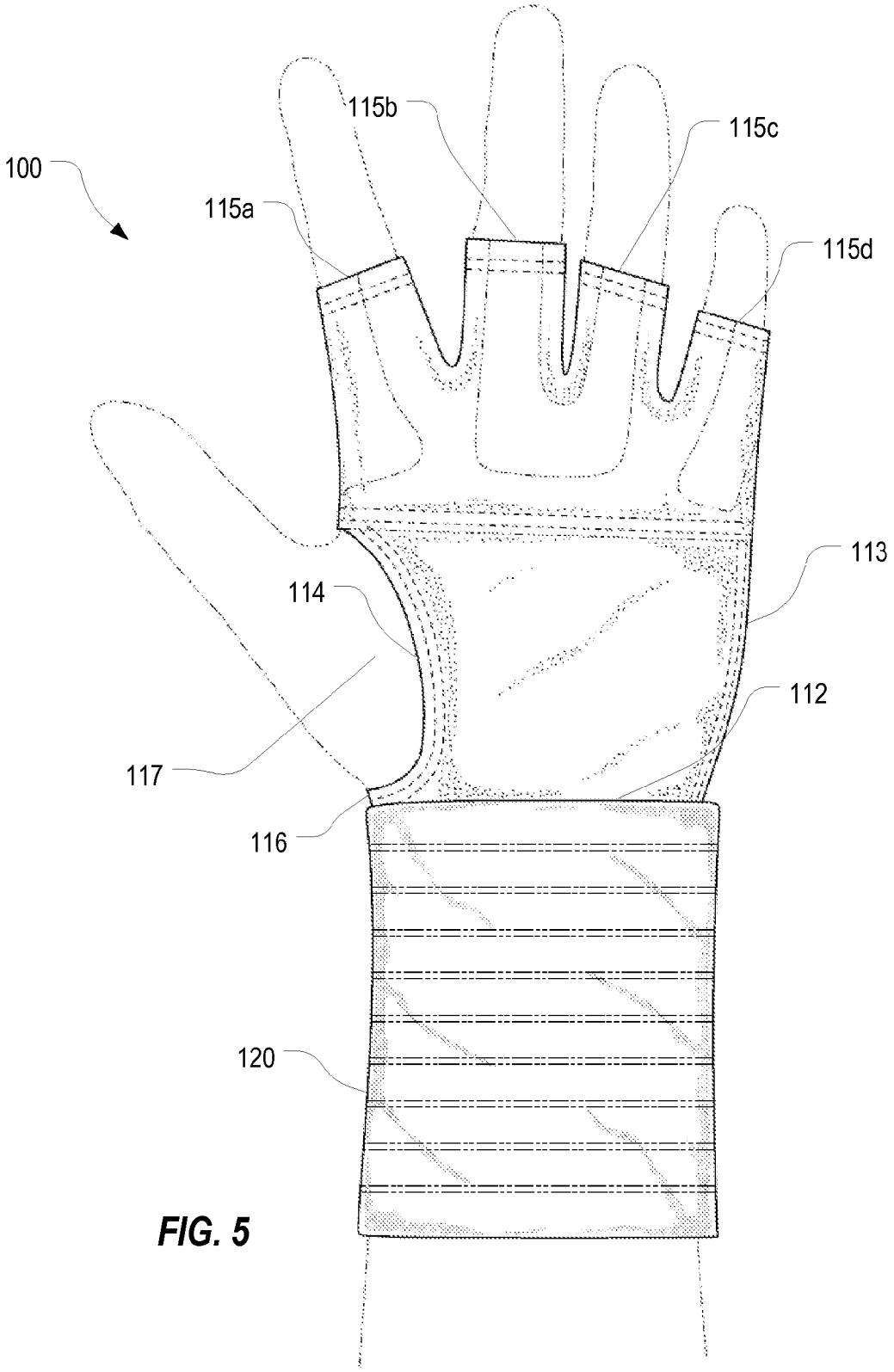
FIG. 5 illustrates a front side view of a left-handed workout glove in accordance with one or more embodiments of the present invention when worn on the left hand.

Hand portion 110 also includes a thumb opening 117. Thumb opening 117 is configured so that the entire thumb remains exposed. In some embodiments, thumb opening 117 may be configured so that a portion of the wearer's palm is also exposed. For example, as best shown in FIGS. 3 and 5, an inside edge 114 of hand portion 110 may curve inwardly as it extends downwardly thereby exposing a portion of the palm at the base of the thumb. To create thumb opening 117, hand portion 110 may include a strip 116 that is configured to extend from back-side proximal edge 111 and wrap around the base of the thumb where it connects to front-side proximal edge 112.

In some embodiments of a workout glove, such as glove 100, a back-side proximal edge 111 does not extend as far down the hand as front-side proximal edge 112. In such cases, a portion of the back side of the wearer's hand remains uncovered. For example, back-side proximal edge 111 can be configured so that it is positioned near the wearer's knuckles (i.e. the metacarpophalangeal joints). In such cases, the back side of the glove can cover the wearer's knuckles while leaving a majority of the back side of the hand uncovered.

Figure 2:
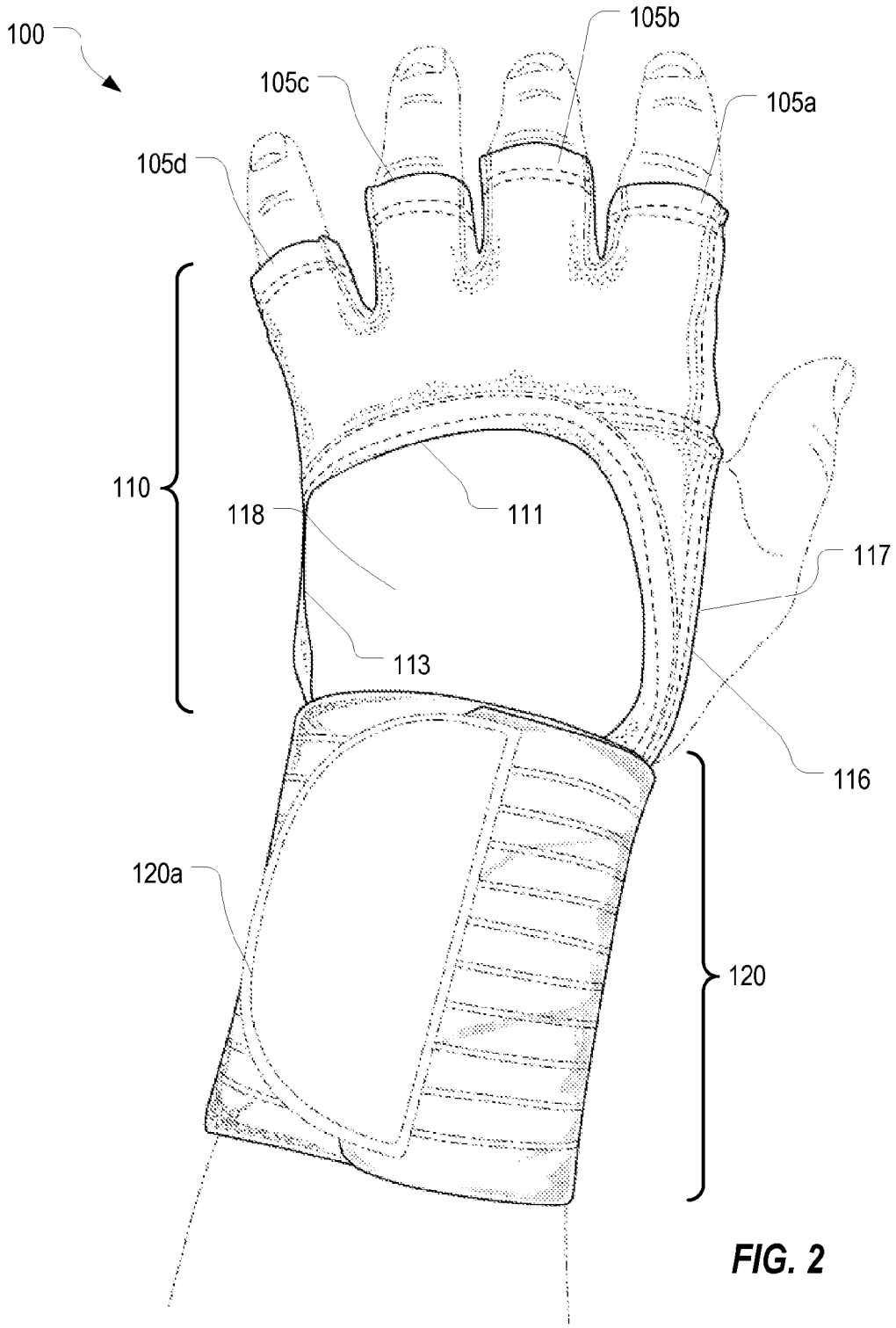
FIG. 2 illustrates a back side view of a left-handed workout glove in accordance with one or more embodiments of the present invention when worn on the left hand.
Figure 4:
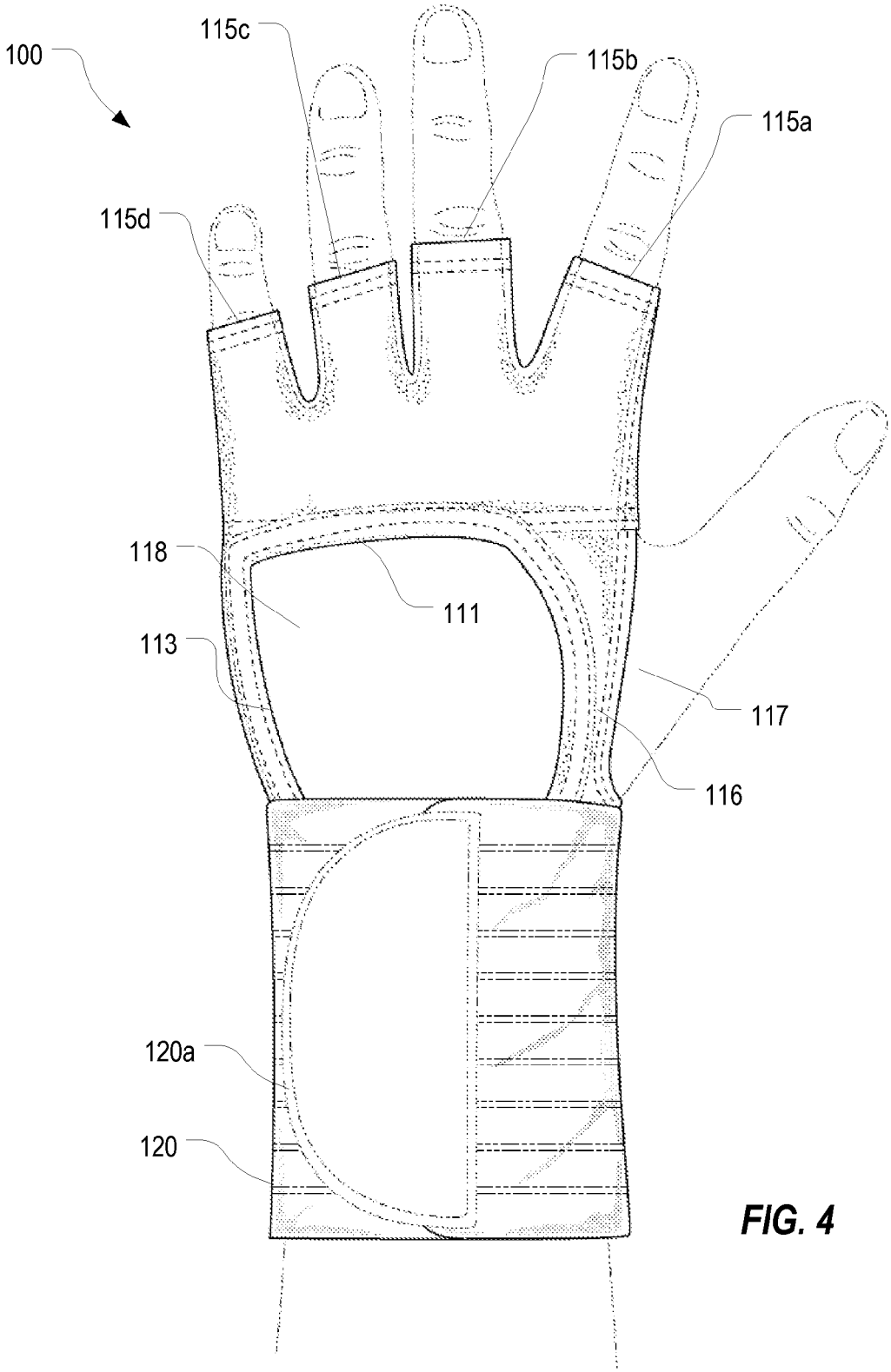
FIG. 4 illustrates a back side view of a left-handed workout glove in accordance with one or more embodiments of the present invention when worn on the left hand.
Figure 6:
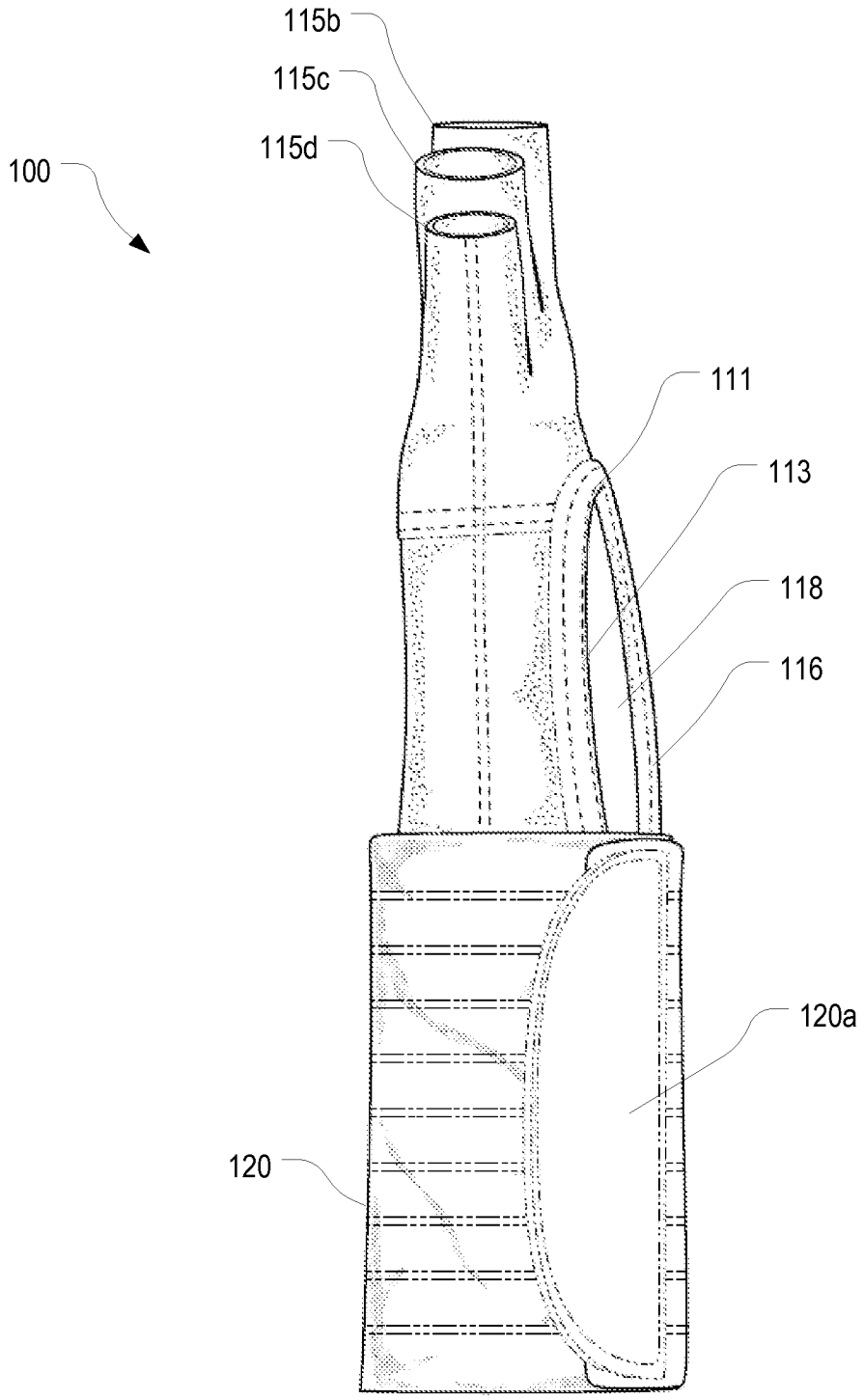
FIG. 6 illustrates a left side view of a left-handed workout glove in accordance with one or more embodiments of the present invention.
Figure 7:
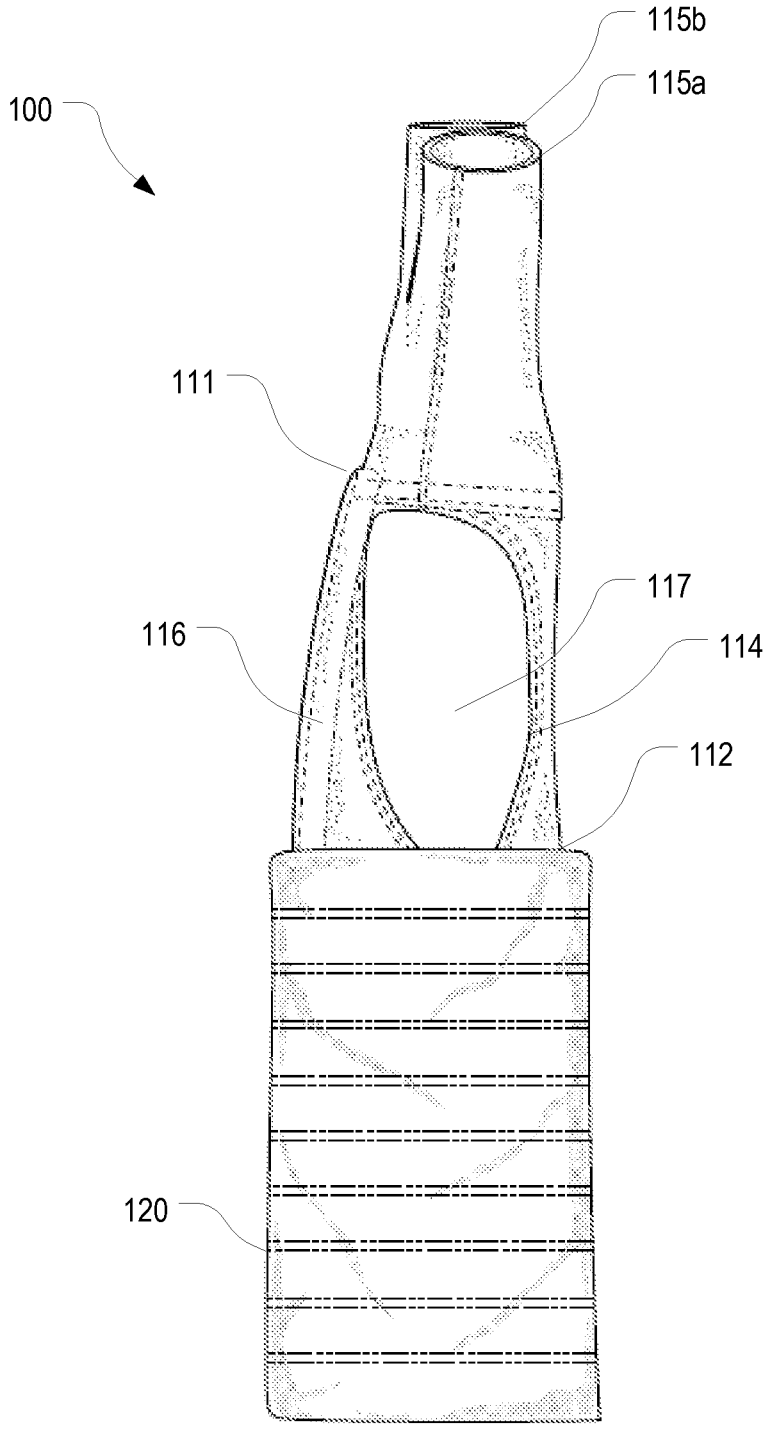
FIG. 7 illustrates a right side view of a left-handed workout glove in accordance with one or more embodiments of the present invention.

For example, as shown in FIG. 2, an opening 118 is formed between back-side proximal edge 111 and wrist wrap 120 with strip 116 being the only portion of hand portion 110 that extends along the back side of the hand to back-side proximal edge 112. In such embodiments, an outer edge 113 of hand portion 110 does not wrap around to the back side of the wearer's hand. In contrast, in some embodiments, outer edge 113 may wrap around to the back side of the wearer's hand as shown in FIGS. 4 and 6.

In embodiments of the invention, hand portion 110 can be formed of multiple materials. For example, a front or palm side of hand portion 110 can be formed of a leather material while a back side of hand portion 110 can be formed of a spandex or other elastic material. Employing a leather or similar material on the palm side can provide a strong, long-lasting material to aid in preventing blisters or calluses while working out, while employing an elastic material such as spandex on the back side increases the comfort and wearability of the glove.

In some embodiments, different materials can be employed on the palm side of hand portion 110. As stated above, a leather or similar material can be used over the knuckles to prevent blisters or calluses during workout while an elastic material may be connected to the leather material at a location below the knuckles and extend along the palm down to front-side proximal edge 112. Typically, wrist wrap 120 can be formed of an elastic material; however, non-elastic materials can also be used.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A workout glove comprising:

a hand portion within which a wearer's hand is placed; and a wrist wrap attached along a front-side proximal edge of the hand portion and configured to extend around the wearer's wrist when the wearer's hand is placed in the hand portion;

wherein the hand portion includes one or more open-ended sheaths through which corresponding one or more of the wearer's fingers extend and a thumb opening through which the wearer's thumb extends, the thumb opening exposing the wearer's thumb, the hand portion further forming an opening on the back side of the wearer's hand, the opening being formed between a back-side proximal edge on the back side of the hand portion and the wrist wrap.

2. The workout glove of claim 1, wherein the thumb opening exposes a portion of the wearer's palm.

3. The workout glove of claim 1, wherein the opening on the back side of the hand is also formed by a strip that extends from the back side proximal edge around the thumb to the front side proximal edge.

4. The workout glove of claim 3, wherein the front side proximal edge is positioned at the wrist joint.

5. The workout glove of claim 1, wherein the opening on the back side of the wearer's hand extends at least partially around the outside of the wearer's hand.

6. The workout glove of claim 1, wherein the one or more open-ended sheaths comprise four open-ended sheaths.

7. The workout glove of claim 1, wherein the one or more open-ended sheaths extend up to the second knuckle of the corresponding one or more fingers.

8. The workout glove of claim 1, wherein the wrist wrap does not connect along the back-side proximal edge of the hand portion.

9. The workout glove of claim 8, wherein the back-side proximal edge is positioned at or near the metacarpophalangeal joints of the wearer's hand.

10. A workout glove comprising:

a hand portion having a front-side proximal edge that extends to a wearer's wrist, a thumb opening that exposes the wearer's thumb, and one or more open-ended sheaths through which corresponding one or more of the wearer's fingers extend; and a wrist wrap that attaches to the hand portion along the front-side proximal edge;

wherein the hand portion further includes a back-side proximal edge that is positioned at or near the wearer's knuckles such that an opening is formed between the back-side proximal edge and the wrist wrap when the wrist wrap is secured around the wearer's wrist.

11. The workout glove of claim 10, wherein the hand portion includes an outer edge that extends along an outer edge of the wearer's palm.

12. The workout glove of claim 10, wherein the hand portion includes an outer edge that extends along an outer edge of the back side of the wearer's hand.

13. The workout glove of claim 10, wherein the hand portion includes an inner edge that curves inwardly as the inner edge extends downwardly towards the wrist wrap thereby causing the thumb opening to expose a portion of the wearer's palm.

14. The workout glove of claim 10, wherein the one or more open-ended sheaths comprise four open-ended sheaths corresponding to the four fingers of the wearer's hand.

15. The workout glove of claim 14, wherein each open-ended sheath extends to a second knuckle of the wearer's hand.

16. The workout glove of claim 10, wherein the open-ended sheaths are formed of leather and a portion of the hand portion that covers the palm is formed of spandex.

17. A workout glove comprising:

a hand portion forming four open-ended sheaths through which a wearer's fingers extend, each open-ended sheath exposing an end of the wearer's finger, the hand portion extending on a back side to a back-side proximal edge and on a front side to a front-side proximal edge, the hand portion including a strip that extends from the back-side proximal edge around the wearer's thumb to the front-side proximal edge, the strip defining a thumb opening through which the wearer's thumb extends such that the wearer's thumb is exposed; and a wrist wrap that attaches to the hand portion along the front-side proximal edge.

18. The workout glove of claim 17, wherein the back-side proximal edge is positioned at or near the wearer's knuckles.

19. The workout glove of claim 17, wherein the hand portion includes an inner edge that curves inwardly as the inner edge extends downwardly towards the strip thereby causing the thumb opening to expose a portion of the wearer's palm.

20. The workout glove of claim 17, wherein the open-ended sheaths are formed of a first material and a portion of the hand portion that covers the palm is formed of a second material.

* * * * *